United States Patent [19]

Liedes et al.

[11] Patent Number: 4,932,138

[45] Date of Patent: Jun. 12, 1990

[54] METHOD AND DEVICE FOR THREADING A WEB AROUND DRYING CYLINDERS

[75] Inventors: Allan Liedes, Palokka; Markku Karlsson, Parainen, both of Finland

[73] Assignee: Valmet Paper Machinery Inc., Finland

[21] Appl. No.: 320,984

[22] Filed: Mar. 9, 1989

[30] Foreign Application Priority Data

Mar. 9, 1988 [FI] Finland ..... 881105

[51] Int. Cl.[5] ..... F26B 5/00

[52] U.S. Cl. ..... 34/23; 34/115; 34/120; 162/370

[58] Field of Search ..... 34/113, 114, 115, 116, 34/117, 120, 23; 162/193, 370, DIG. 7; 68/DIG. 5; 15/306 A

[56] References Cited

U.S. PATENT DOCUMENTS

| | | | |
|---|---|---|---|
| 2,714,342 | 8/1955 | Beachler | 162/370 |
| 3,091,563 | 5/1963 | Meyer | 162/DIG. 7 |
| 4,202,113 | 5/1980 | Kankaanpaa | 34/114 X |
| 4,483,083 | 11/1989 | Chance | 34/116 X |

*Primary Examiner*—Henry A. Bennett

*Assistant Examiner*—John Sollecito

*Attorney, Agent, or Firm*—Steinberg & Raskin

[57] ABSTRACT

Method and device in a drying group or groups provided with a single wire draw, in a multi-cylinder dryer of a paper machine for securing the threading of the web. The multi-cylinder dryer has drying cylinders heated by steam or equivalent, with the web to be dried being pressed by the drying wire into direct contact with cylinder faces of the drying cylinders. The multi-cylinder dryer also has leading cylinders or rolls on which the web remains outside the drying wire. In the area of single-wire draw, the leading cylinders or rolls are provided with a suction zone situated at a side of the service-side end of the rolls. The suction zone is provided by way of perforations passing through a mantle of the leading cylinders or rolls. The negative pressure present in an interior space in the leading cylinders is spread onto the outer faces thereof through the perforations and by way of grooves situated within the area of the suction zone and passing around the roll mantle. The sector of the leading cylinders or rolls that remains free from the drying wire and from the web, is closed over the suction zone by way of an outer closing arrangement.

11 Claims, 4 Drawing Sheets

METHOD AND DEVICE FOR THREADING A WEB AROUND DRYING CYLINDERS

BACKGROUND OF THE INVENTION

The present invention concerns a method in the drying group or groups provided with a single-wire draw in a multi-cylinder dryer of a paper machine, for securing the threading of a web, the multi-cylinder dryer having drying cylinders heated by means of steam or equivalent. The web to be dried is pressed by the drying wire into direct contact with the cylinder faces of the drying cylinders. The multi-cylinder dryer also comprises leading cylinders or rolls, on which the web remains outside of the drying wire.

The present invention also concerns a device used in carrying out the above method, this device being applied in the area of a single-wire draw in a paper machine. The dryer comprises a line of heated drying cylinders, preferably upper cylinders, and a line of leading cylinders or rolls, with the web running between these lines by being supported while a drying wire so that the web is, on the heated drying cylinders, pressed by the drying wire into direct contact with the heated face of the drying cylinders, while on the leading cylinders or rolls the web is situated on an outer face of the drying wire. The leading cylinders or rolls are provided with outside grooves.

Furthermore, the device comprises arrangements situated in spaces between the drying cylinders and operating against free sectors of the leading cylinders, by means of which a reduced pressure level is maintained in the grooves. This reduced pressure level promotes adherence of the web to the drying wire on the sector of the outside curve.

It is frequently a problem with threading of a paper web in the area of a single-wire draw in the drying section of a paper machine, that on the lower cylinder or roll the leader is detached from the drying web, whereby the leader tends to move around and to be driven out of the machine.

In a manner known in the prior art, attempts have been made to eliminate this problem by increasing the difference of draw of the web out of these groups. Adjusting of the difference of draw to the correct level requires high precision, since an excessively high difference of draw cuts off the leader, and the attempt of threading must be restarted from the beginning. An increased difference of draw at the initial end of the machine reduces the strength of the paper at the final end of the machine, because the paper loses its potential of extension, and its elongation at rupture and its breaking energy become lower. This fact causes problems in the final end of the machine during threading.

In the area of the single-wire draw, when threading by means of ropes is employed, it is a further problem that the leader must be transferred in the lateral direction outwardly to the area of the ropes. This transfer requires devices of its own, which must be placed in a congested space. Moreover, the drying wire of the single-wire draw makes this lateral transfer more difficult.

With respect to the prior art related to the present invention, reference is made to the following patents or literature:

FI Pat. Appl. No. 771056 (Valmet Oy);
WO 83/00514 (J. M. Voith GmbH);

FI Pat. Appl. No. 862413 (Valmet Oy); and
FI Pat. Appl. No. 873812 (Valmet Paper Machinery, Inc.).

SUMMARY OF THE INVENTION

Accordingly, it is an object of the present invention to further improve and develop over the prior-art methods and devices such as described above.

It is also an object of the present invention to avoid the above-noted drawbacks with respect to the prior-art methods and devices.

It is an additional object of the present invention to provide a method and a device wherein, in an area of a single-wire draw in a drying section, the leader can be supported on the lower cylinders.

It is a further object of the present invention to provide a method and a device in which it is possible to use relatively simple constructions so that the application of the method does not involve high extra expenses and investments in equipment.

Accordingly, these and other objects are attained by the present invention which is directed to a method for threading a web through a group of drying cylinders which comprises at least one leading cylinder or roll, comprising the steps of generating a suction zone through a sector of a mantle of the at least one leading cylinder or roll about which the web passes by providing perforations passing through the mantle, whereby negative pressure within an interior of the leading cylinder or roll is passed to an outer surface of the mantle within the sector, and closing off the suction zone about a remaining sector of the mantle which is free of the passing web, by means of an outside closing arrangement. The groups of drying cylinders form a multi-cylinder dryer of a paper machine having at least one heated cylinder, with the web passing about cylinders in the group supported on a wire as a single wire draw, which presses the web against the heated drying cylinder and is interposed between the web and the outer mantle surface of the leading cylinder about the suction sector thereof. The suction zone is generated by additionally providing grooves on the outer mantle surface communicating with these perforations. Preferably, the at least one drying cylinder is heated by steam, while the suction zone is generated at a service side end of the cylinders or rolls.

The present invention is also directed to a device for threading a web through a group of drying cylinders, comprising at least one leading cylinder having perforations through a mantle thereof opening, at one end, into an interior space within the mantle and at an opposite end, onto an outer surface of the mantle, means for generating a negative or suction pressure within the interior space, whereby a suction zone is generated over a sector of the mantle about which the web passes by the negative pressure being passed to the outer surface of the mantle within the sector, and an outside closing arrangement for closing off the suction zone about a remaining sector of the mantle which is free of the passing web. The group of drying cylinders forms a multi-cylinder dryer of a paper machine having at least one heated cylinder, with the web passing about the cylinders in the group supported on a wire as a single wire draw which presses the web against the heated cylinder and is interposed between the web and the outer mantle surface of the leading cylinder, about the suction sector thereof. The outer surface of the mantle is provided with grooves into which the perforations open, so that a reduced pressure level is maintained in these grooves which promotes adherence of the web to the drying wire on the suction sector which is arranged around an outside curve of the leading roll.

In view of achieving the objects stated above and those which will become apparent below, the method of the present invention is principally characterized by, in an area of a single-wire draw, the leading cylinders or rolls being provided with a suction zone situated at a side of the service-side end of the cylinders or rolls, this suction zone being provided by means of perforations passing through the mantle of the leading cylinders or rolls. Through the perforations, the negative pressure present in an interior space in the leading cylinders is spread onto the outer faces thereof by means of grooves situated within the area of the suction zone and passing around the roll mantle. The sector of these leading cylinders or rolls that remains free from the drying wire and from the web, is closed over the suction zone by means of an outer closing arrangement.

On the other hand, the device in accordance with the present invention is principally characterized by the outer grooves in the mantles of the leading cylinders or rolls being provided, within the natural path of the leader band, with through perforations which are opened into the grooves. The interior space in the leading cylinders or rolls is connected, by means of a suction duct, to a suction blower or an equivalent suction source. The sector of the leading cylinders or rolls free from the drying wire and from the web is provided with a closing box or equivalent, which substantially prevents access of air into the grooves provided with negative pressure within this sector for the purpose of threading.

The problems discussed above at the beginning can be avoided by providing the lower cylinders rolls, in the area of the single-wire draw, with a narrow suction zone which keeps the leader in tight contact with the drying wire so that there is no need to increase the differences of draw at the initial end of the machine, whereby the preserved potential of extension can be utilized at the final end of the machine if necessary.

The suction zone to be applied in the invention can be accomplished in a number of different ways. One advantageous mode is to provide the Valmet so-called UNO ROLL (TM) with a suction zone so that at the service-side end of the roll, within an area of the width of the leader band which is, e.g., about 200 to 300 mm, about 20 to 100 pcs. of holes for example, are drilled into each groove through the roll mantle, the diameter of the holes being, e.g. 4 to 5 mm. The roll axle is provided with a through hole which communicates with the suction side of a blower. The suction effect is applied to the leader through the drying wire, which has a naturally relatively high permeability. The control of the blower can be connected to the normal break automation of the paper machine so that negative pressure is automatically switched on to the suction zone of the roll when the threading is started.

The present invention also involves the advantage that, in the area of single wire draw, the leader band can be passed transversely exactly at the point at which it is cut apart from the web. Thus, no transverse shiftings of the leader are required which are difficult to carry out and susceptible to disturbance. Due to the present invention, the transverse shifting of the leader may be accomplished only in the area of twin-wire draw in the drying section if necessary, where the leader band has open draws, e.g., in the gaps between groups of rolls or between upper and lower cylinders.

BRIEF DESCRIPTION OF THE DRAWINGS

The present invention will be described in greater detail below with reference to certain exemplary embodiments of the invention illustrated in the accompanying drawings, and to which the present invention is by no means intended to be strictly confined. In the drawings

DESCRIPTION OF THE PREFERRED EMBODIMENTS

Figure 1:
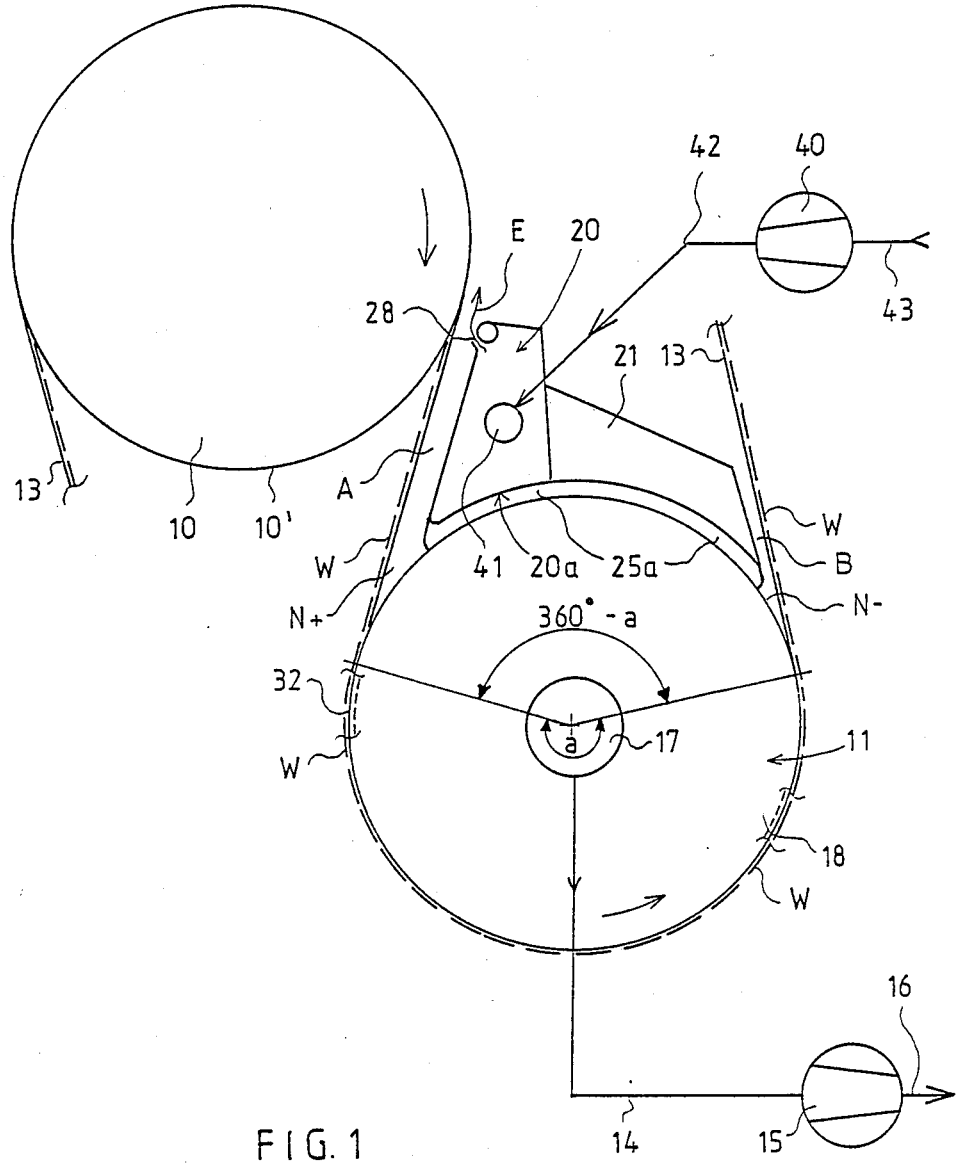
FIG. 1 is a schematic side view of a part of a group of drying cylinders in a paper machine in which the method in accordance with the present invention is applied.

FIG. 1 illustrates only one steam-heated upper cylinder 10 and a lower cylinder 11 provided with a grooved face, out of the cylinder group in a multi-cylinder dryer in a drying section of a paper machine, this latter cylinder 11 acting only as a leading cylinder. The web W is introduced on the drying wire 13 of a single-wire draw so that, pressed by the drying wire 13, the web W enters into direct contact with the heated faces 10' of the upper cylinder 10. On the leading cylinders 11, the web W remains at the side of the outer curve on the face of the drying wire 13. In the spaces between the upper cylinders 10, against a free sector 360°-a of the leading cylinders 11, blow boxes 20 are provided and, in conjunction with the same, sealing boxes 21 which are necessary in the present invention are provided too.

At a small distance from the run of the wire 13, the blow boxes 20 have a plane wall 29 whose upper edge is provided with a nozzle slot 28. In the blow boxes, the same technique is employed as in the UNO RUN BLOW BOX (TM) patented by Valmet. The nozzle slot 28 is formed in conjunction with a tube part 27, and blowings E are directed through the nozzle slot 28 in a direction opposite to a direction of running of the wire 13 which runs to facing the nozzle slot 28. These blowings E eject a negative pressure in the space A between the wall 29 and the drying wire 13, and in an inlet nip N+ between the cylinder 11 and the wire 13. This nip N+ constitutes an extension for the space A and would otherwise be provided with a positive pressure. Character N- denotes the outlet nip, as clearly seen in the figures.

Blowing air at a suitable positive pressure is introduced into the blow box 20 through an inlet opening 41 and an inlet pipe 42 from a blower 40, whose intake duct is denoted by reference numeral 43 in FIG. 1. In the manner described above, the space A and the nip N+ can be subjected to a negative pressure, which promotes the adherence of the web W to the drying wire 13. This effect of negative pressure is spread into grooves 32 in mantle 30 of the lower cylinders 11, whereby the web W adhering to the outer face of the drying wire 13 within the roll sector a when the web is unsupported from outside, is partially achieved.

Therefore, by means of positioning the blow box 20 as described, an area A of negative pressure is produces on the straight run of the drying wire 13 and the web W passing from the heated cylinders 10, preferably upper cylinders, to the leading cylinders or rolls, and further into the inlet nip N+ between the mantle 30 and the incoming drying wire 13. Positive pressure normally tends to be induced in this incoming nip N+ by the effect of boundary-layer flows.

The blow boxes 20 which are situated in the area of the single-wire draw facing each cylinder 11, extend over substantially the entire width of the web W and of the grooves 32*a* in the mantle 30 of the cylinder in the transverse direction. The blow box 20 is also provided with lateral nozzles.

Figure 2:
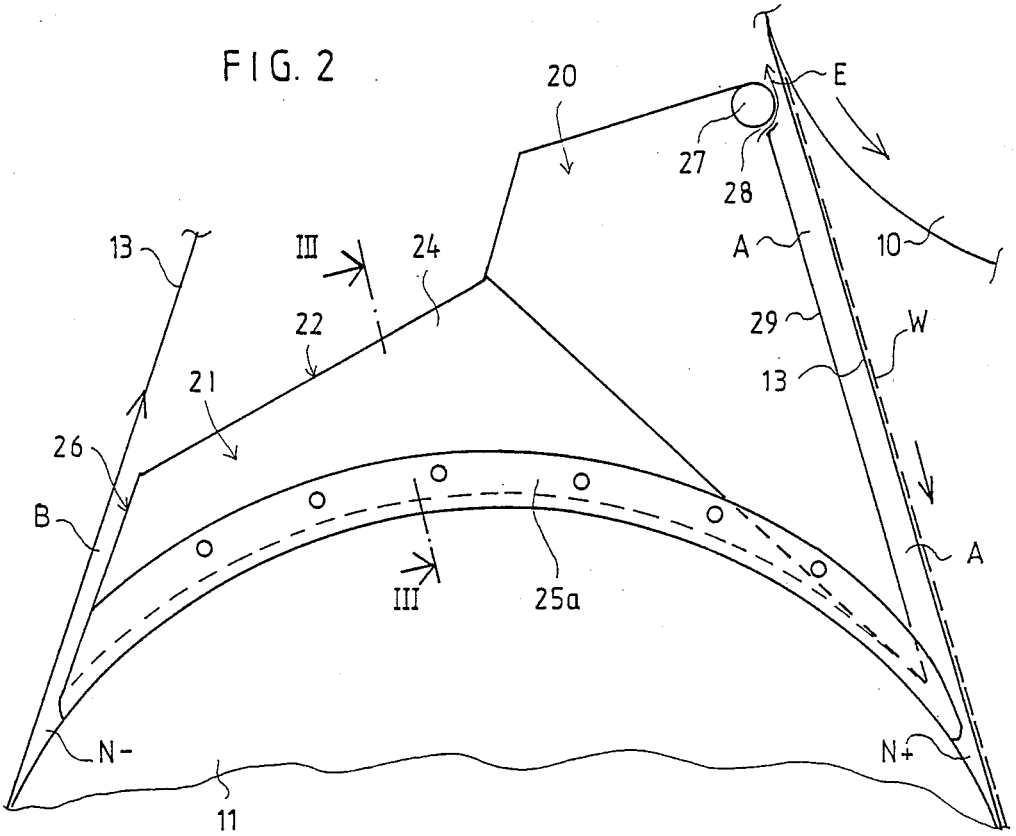
FIG. 2 is a schematic side view of a device applied in the invention.
Figure 3:
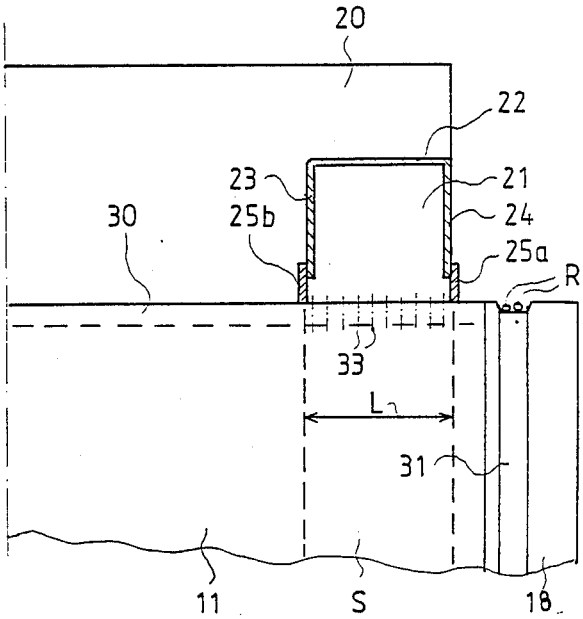
FIG. 3 is a sectional view along line III—III of FIG. 2.
Figure 4:
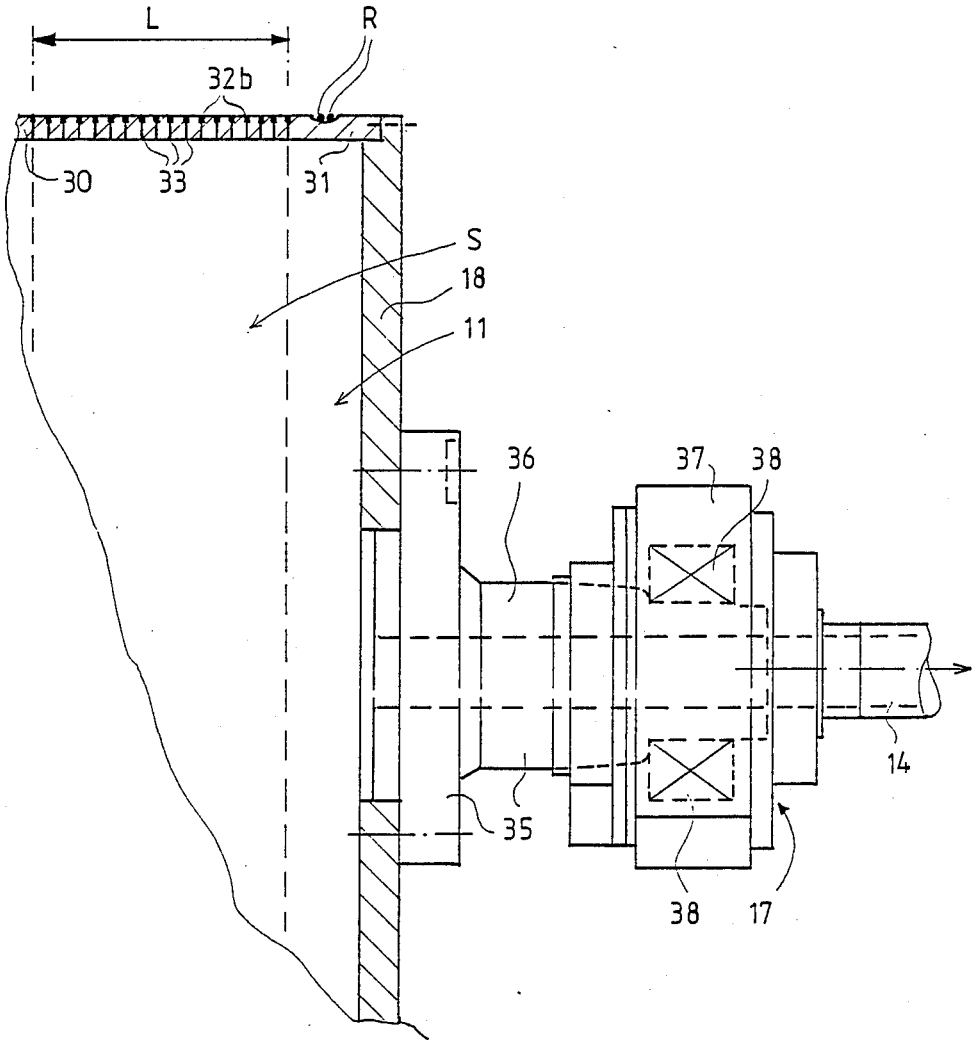
FIG. 4 is a transverse sectional view of the grooved roll applied in the invention and of a suction duct situated in conjunction with an axle journal thereof.
Figure 5:
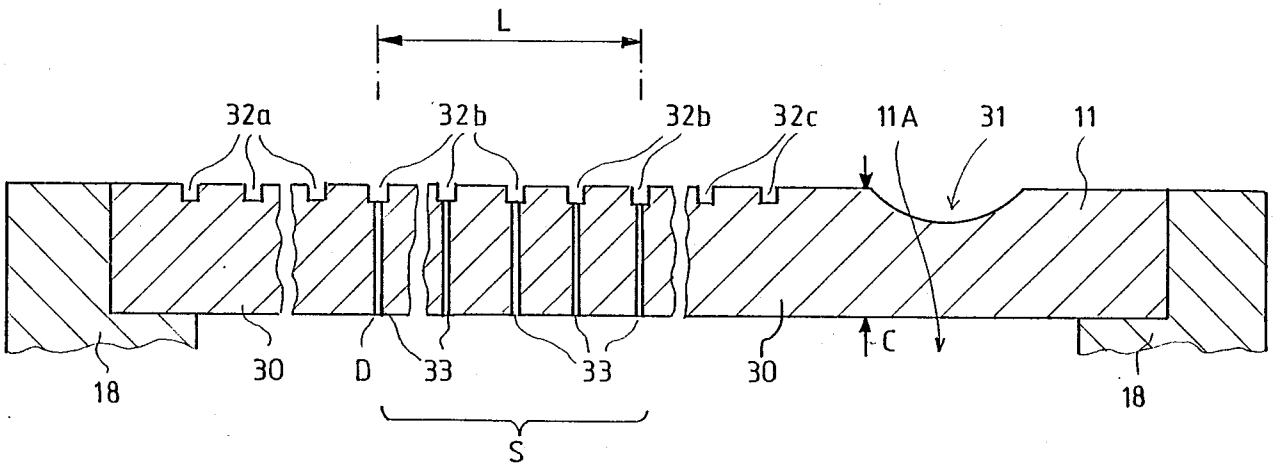
FIG. 5 is an axial sectional view of the mantle of the grooved roll applied in accordance with the present invention.

In accordance with FIGS. 1, 2 and 3, a sealing box 21 is connected with the blow box 20, this sealing box 21 extending only over a certain width L at the service side of the cylinder 11, in the proximity of the end 18 of the leading cylinders. As shown in FIG. 5, the mantles 30 of the leading cylinders 11 are provided, starting from the service-side end 18, first with a rope R groove 31, then with a few solid-bottom grooves 32*c*, and then with open grooves 32*b* situated inside the sealing box 21. These open grooves 32*b* communicate with an interior space 11A in the cylinder 11 through perforations 33 passing through the mantle 30. The remaining part of the cylinder 11 mantle is provided with solid-bottom circular grooves 32*a*.

The sealing box 21 is provided with walls 23 and 24 situated in the machine direction, and with an upper wall 22 and a wall 26, this wall 26 situated at a certain distance B from an outlet run of the drying wire 13. These walls along with sealing ribs 25*a* and 25*b* of the box 21 which operate against an outer face of the cylinder 11, define a closed space inside of the same. The sealing ribs 25*a* and 25*b* are made, e.g., of teflon and have a gap of, e.g., 0 to 22 mm relative to the outer face of the mantle 30 of the cylinder 11. If the area of the sealing box 21 does not extend over the entire free sector of the cylinder 11, some of this sector may be closed by means of a wall 20*a* of the blow box 20, as illustrated in FIG. 1.

In other words, the closing and sealing box 21, comprises side walls 23 and 24 situated at a distance from one another determined by the width L of the suction zone S of the cylinder or roll 11. The box 21 also has outer walls 22 and 26 which connect the side walls 23 and 24. Furthermore, in conjunction with the side walls 23 and 24, sealing ribs 25*a* and 25*b* are situated at the side of the cylinder mantle 30 as illustrated to operate against the mantle 30. These sealing ribs 25*a* and 25*b* extend substantially over the free sector 360°-a of the leading cylinders or rolls.

A suction duct 17 is connected to the axle journal 35 at the service-side end 18 of the cylinder 11. This suction duct 17 is fixed, with bearings 38 being provided in conjunction therewith and being situated against the revolving axle journal 35. A suction roll 36 passes through the axle journal 35 and has a diameter, e.g., about 100 mm. The suction duct 17 is a bearing cover provided with a seal and with an opening. The suction duct 17 communicates with a suction pipe 14 which, in turn, is connected to the suction side of a blower 15. A pipe at a pressure side of the blower 15 is denoted by reference numeral 14 in FIG. 1.

The stages of the method of the invention and operation of the device described above will be described below.

In the manner described above, the leading cylinders 11 or equivalent rolls on which the web W is situated on the outer face of the drying wire 13, are provided with a narrow (width L) suction zone S. Due to the grooves 32*b*, this suction zone S extends over the entire sector a of the cylinders 11 within which the drying wire 13 and the web W are in contact with the lower cylinders 11. By the effect of the negative pressure in this suction zone, the leader band of the web W is maintained tightly in contact with the lower face of the drying wire 13 within the sector a.

The suction effect in the suction zone S of the sector a is produced inside the roll or cylinder 11 by means of a suction blower 15, which generates a negative pressure in the opening-bottom grooves 32*b* of the suction zone through bores 33 in the mantle 30. The suction effect is partially maintained within the open sector 360°-a, by closing the grooves 32*b* as tightly as possible from outside by means of the sealing box 21 and the lateral seals 25*a*. This is contributed by the negative pressure in the area A in the blow box 20 and in the inlet nip N+, this negative pressure being produced by means of the ejection blowings E of the box 20.

The negative pressure in the interior space 11A in the leading cylinder 11 is, as a rule, within the range of about 750 to 1500 Pa, preferably about 1000 Pa. Into each groove 32*b*, about 20 to 100 pcs., most appropriately about 25 to 40 pcs. of bores 33 are opened, each having a diameter, as a rule, within the range of about 3 to 6 mm, preferably about 4 to 5 mm. Thus, even though the hole area of the bores 33 is only about 1% of the area of the suction zone S, the negative pressure is effective over the entire area of the grooves 32*b* which is preferably about 25% of the area of the suction zone S.

The method and device in accordance with the present invention are advantageously applied so that the air blower 15 is automatically switched on to operate from the normal break automatio of the paper machine when the threading begins, while after the threading has been completed, the blower 15 operation is switched off. In the present invention, the suction zone S is advantageously combined with the structure and operation of the UNO RUN box (TM) and the UNO ROLL (TM). By means of the suction zone S, the threading in the area of the single-wire draw can be accomplished ever more reliably.

The preceding description of the present invention is merely exemplary, and is not intended to limit the scope thereof in any way.

What is claimed is:

1. Method for threading a web through a group of drying cylinders which comprises at least one leading cylinder or roll, comprising the steps of generating a suction zone through a sector of a mantle of the at least one leading cylinder or roll about which the web passes by providing perforations passing through the mantle, whereby negative pressure within an interior of the leading cylinder or roll is passed to an outer surface of the mantle within this sector, and closing off the suction zone about a remaining sector of the mantle which is free of the passing web, by means of an outside closing arrangement wherein the group of drying cylinders forms a multi-cylinder dryer of a paper machine having at least one heated cylinder, with the web passing about cylinders in the group supported on a wire as a single wire draw, which presses the web against the heated drying cylinder and is interposed between the web and the outer mantle surface of the leading cylinder about the suction sector thereof, and wherein said suction zone is generated by additionally providing grooves on the outer mantle surface communicating with said perforations.

2. The method of claim 1, wherein the at least one drying cylinder is heated by steam, and the suction zone is generated at a service side end of the cylinder or roll.

3. Method for threading a web through a group of drying cylinders which comprises at least one leading cylinder or roll, comprising the steps of generating a suction zone through a sector of a mantle of the at least one leading cylinder or roll about which the web passes by providing perforations passing through the mantle, whereby negative pressure within an interior of the leading cylinder or roll is passed to an outer surface of the mantle within this sector, and closing off the suction zone about a remaining sector of the mantle which is free of the passing web, by means of an outside closing arrangement wherein the group of drying cylinders forms a multi-cylinder dryer of a paper machine having at least one heated cylinder, with the web passing about cylinders in the group supported on a wire as a single wire draw, which presses the web against the heated drying cylinder and is interposed between the web and the outer mantle surface of the leading cylinder about the suction sector thereof, and comprising the additional step of arranging a blow box for generating an area of negative pressure on a straight run of the wire and web from the at least one heated cylinder to the at least one leading cylinder or roll, and further into an inlet nip defined between the leading cylinder or roll mantel and incoming wire.

4. Device for threading a web through a group of drying cylinders, comprising at least one leading cylinder having perforations through a mantle thereof opening, at one end, into an interior space within the mantle and at an opposite end, onto an outer surface of the mantle, means for generating a negative or suction pressure within the interior space, whereby a suction zone is generated over a sector of the mantle about which the web passes by the negative pressure being passed to the outer surface of the mantle within this sector, and an outside closing arrangement for closing off the suction zone about a remaining sector of the mantle which is free of the passing web wherein the group of drying cylinders forms a multi-cylinder dryer of a paper machine having at least one heated cylinder, with the web passing about the cylinders in the group supported on a wire as a single wire draw which presses the web against the heated cylinder and is interposed between the web and the outer mantle surface of the leading cylinder about the suction sector thereof, and wherein the outer surface of the mantle is provided with grooves into which said perforations open, a reduced pressure level maintained in said grooves promoting adherence of the web to the drying wire on said suction sector which is arranged around an outside curve of the leading cylinder or roll.

5. The combination of claim 4, wherein the group of drying cylinders forms a multi-cylinder dryer of a paper machine having at least one heated cylinder, with the web passing about the cylinders in the group supported on a wire as a single wire draw which presses the web against the heated cylinder and is interposed between the web and the outer mantle surface of the leading cylinder about the suction sector thereof.

6. The combination of claim 4, wherein said closing arrangement is a box arranged to substantially prevent access of air into said grooves over said remaining sector of the cylinder or roll.

7. The combination of claim 6, wherein said box comprises side walls extending in a machine direction and spaced across from one another substantially by a width of said suction zone, outer walls connecting said side walls, and sealing ribs mounted upon said respective side walls at a side of the cylinder mantle, operating against the mantle, and extending substantially over said free remaining sector of the leading cylinder or roll.

8. The combination of claim 6, additionally comprising a blow box fitted in conjunction with said sealing box to extend substantially across an entire width of the web and provided with a planar wall and a nozzle slot at one edge of said wall, said nozzle slot being located where the web and wire depart from the heated cylinder, and said planar wall extending into an inlet nip formed by the wire and the leading cylinder or roll.

9. The combination of claim 4, wherein each said groove of said suction zone of the leading cylinder or roll comprises about 20 to 100 of said perforations, and each said perforation has a diameter of about 3 to 6 mm.

10. The combination of claim 9, wherein each said groove comprises about 25 to 40 of said perforations, and said perforation diameter is about 4 to 5 mm.

11. The combination of claim 4, wherein proportion of area of said perforations in said suction zone of the leading cylinder or roll is of an order of about 1% of an entire area of said suction zone, and proportion of area of said grooves in said suction zone is about $\frac{1}{4}$ of the entire suction zone area.

* * * * *